US008402675B2

(12) United States Patent
Hill et al.

(10) Patent No.: US 8,402,675 B2
(45) Date of Patent: Mar. 26, 2013

(54) FOOTWEAR CONSTRUCTION AND RELATED METHOD OF MANUFACTURE

(75) Inventors: Brandan J. Hill, Ada, MI (US); James S. Lindars, Huntington, VT (US)

(73) Assignee: Wolverine World Wide, Inc., Rockford, MI (US)

( * ) Notice: Subject to any disclaimer, the term of this patent is extended or adjusted under 35 U.S.C. 154(b) by 470 days.

(21) Appl. No.: 12/862,397

(22) Filed: Aug. 24, 2010

(65) Prior Publication Data

US 2012/0047769 A1 Mar. 1, 2012

(51) Int. Cl.
*A43B 3/12* (2006.01)

(52) U.S. Cl. ..... 36/11.5; 36/97; 12/142 S

(58) Field of Classification Search ..... 36/11.5, 36/97, 50.1; 12/142 S
See application file for complete search history.

(56) References Cited

U.S. PATENT DOCUMENTS

| | | | | |
|---|---|---|---|---|
| 2,169,337 | A | 8/1939 | Davis | |
| 2,510,236 | A * | 6/1950 | Kutcher | 36/11.5 |
| 2,926,434 | A * | 3/1960 | Morgan | 36/11 |
| 3,121,962 | A * | 2/1964 | Gullo | 36/11.5 |
| 5,651,195 | A * | 7/1997 | Clancy | 36/11.5 |
| 5,678,325 | A * | 10/1997 | Davidowitz et al. | 36/11 |
| 6,516,538 | B2 * | 2/2003 | Kraft | 36/11.5 |
| 6,952,890 | B1 | 10/2005 | Blakeslee | |
| 7,117,616 | B2 | 10/2006 | Hull | |
| 7,287,342 | B2 | 10/2007 | Keen | |
| 7,681,331 | B2 * | 3/2010 | Bathum | 36/11.5 |
| 2008/0196269 | A1 * | 8/2008 | Bathum | 36/11.5 |
| 2009/0038181 | A1 * | 2/2009 | Loughnane | 36/94 |
| 2009/0313854 | A1 * | 12/2009 | Clarke | 36/97 |

OTHER PUBLICATIONS

2008 Sebago Spring Catalog, pp. 10, 25, 37, 50, 51.

* cited by examiner

*Primary Examiner* — Marie Patterson
(74) *Attorney, Agent, or Firm* — Warner Norcross & Judd LLP

(57) ABSTRACT

A footwear construction including a portion of an upper and/or sole, a strap defining a sleeve, and a cord joined with the upper and/or sole portion, extending toward the strap and slidably housed in the sleeve. An adjustment element is selectively locatable along a part of the cord. By sliding the cord relative to the sleeve and optionally adjusting the location of the adjustment element, the spatial relationship between the strap and the upper and/or sole portion can be selectively adjusted to accommodate a particular dimension of a wearer's foot and/or ankle. A method is also provided for manufacturing footwear including the above components.

20 Claims, 5 Drawing Sheets

FOOTWEAR CONSTRUCTION AND RELATED METHOD OF MANUFACTURE

BACKGROUND OF THE INVENTION

The present invention relates to footwear and, more particularly, to a footwear construction and a method for making the same.

In the footwear industry, there is an ongoing effort to produce footwear that can be securely joined with a user's foot and still provide exceptional comfort. In many footwear, comfort is enhanced by including adjustable securing elements to accommodate a variety of feet having different dimensions and physical characteristics. Examples include: conventional shoestrings or lacing, which can be tightened to the preference of the wearer; buckles, which can be buckled at desired increments; and Velcro® straps which can be overlapped and secured to one another to provide a desired fit and level of secure attachment to the wearer's foot.

While conventional adjustable elements serve their purpose, that is, they provide satisfactory adjustment of certain dimensions of the footwear, they are sometimes difficult to operate, clunky, noisy and/or generally not aesthetically pleasing. As a result, there remains a long felt and unmet need for a footwear construction that provides the desired level of secure attachment, that is comfortable, and that is aesthetically pleasing.

SUMMARY OF THE INVENTION

Footwear is provided including an upper and/or sole portion, a strap defining a sleeve, and a cord that is joined with the upper and/or sole portion that also extends toward the strap and is slidably housed in the sleeve. The cord joins the strap and the upper and/or sole portion. An adjustment element is selectively locatable along a part of the cord to adjust the spatial relationship between the strap and the upper and/or sole portion, thereby facilitating adjustment of at least one dimension of the footwear to achieve a desired fit on a user's foot.

In one embodiment, footwear can be in the form of a sandal. The cord can be joined with a portion of the sole of the footwear. The cord can extend upwardly from the sole between adjacent toes of the wearer. Optionally, the cord can extend between the largest toe and the second toe on the wearer's foot. The cord can join the strap, and provide spatial adjustment of the strap relative to the sole to enable a wearer to select a comfortable fit of the sandal on the wearer's foot.

In another embodiment, the footwear can be in the form of a sandal. The strap can engage a portion of the wearer's ankle to hold the footwear on the wearer's foot. The strap can be adapted to wrap at least partially around the ankle of a wearer. The cord can join the strap with another upper and/or sole portion. The cord can be adjusted in length to accommodate the size of the ankle so that the footwear is securely retained on the foot with the strap engaging the ankle.

In yet another embodiment, the footwear can include first and second straps that extend along lateral and medial portions of the wearer's foot. These straps can join at a junction. Holes or apertures can be defined in one or both of the straps, in communication with a sleeve defined by one or both straps. The cord can extend through both apertures and project a distance beyond the sleeve. An adjustment element can be joined directly to a part of the cord that extends beyond the sleeve.

In still another embodiment, the adjustment element can be in the form of a knot or a lock element. The knot can be any conventional knot tied by the wearer. The lock element can be any element including a housing and a moveable part that engages the cord and holds the housing in fixed relation to the cord. One lock element can include a biasing element and a cord engagement surface. The biasing element can bias the engagement surface against the cord to hold the lock element in a fixed position relative to the cord. Optionally, the engagement surface can be moveable relative to the housing to convert the lock element from a locked mode to an unlocked mode, and vice versa. Further optionally, the lock element can slide relative to the cord and subsequently adjust the length of the cord positioned between a part of the cord extending from the sleeve and another end of the cord. With such an adjustment, the strap can be moved relative to the upper and/or sole portion to alter a dimension of the footwear.

In a further embodiment, a method for manufacturing footwear is provided. In this method, a strap defining a sleeve is provided. The strap can be spaced from the upper and/or sole portion of the footwear. A first end of a cord can be joined with the upper and/or sole portion. The cord can be extended toward the strap and positioned in the sleeve so that the cord is selectively slidable in the sleeve. In turn, the cord can join the strap and the upper and/or sole portion. An adjustment element can be positioned along a part of the cord extending beyond the sleeve to establish a preselected length of the cord, so that the strap is positioned in a preselected spatial relationship relative to the upper and/or sole portion. This preselected spatial relationship can provide desired dimensions of the footwear to comfortably fit the wearer's foot and/or ankle.

In yet a further embodiment, the method can include joining a first end of the cord with the sole in a location in a forefoot region of the footwear. The cord can be configured to extend between at least two adjacent toes of the wearer. The strap can be positioned above the top of the forefoot of the wear's foot so that the strap can be tightened relative to the forefoot and/or other portions of the foot and secure the footwear on the wearer's foot.

In still a further embodiment, the method can include positioning a strap around a portion of the footwear corresponding to the ankle of a wearer. The cord can be configured to extend between the strap and the upper and/or sole portion. The cord can also be adapted to be positioned around at least a portion of the wearer's ankle. The strap can be tightened with a cord relative to the ankle and adapted to secure the strap around the ankle.

The footwear construction described herein provides improved comfort and adjustability. The adjustable components of the footwear are easily and simply implemented in an aesthetically pleasing design. These characteristics are particularly advantageous in a variety of footwear including, but not limited to, sandals, casual footwear, athletic footwear, performance footwear, and other types of footwear.

These and other objects, advantages and features of the invention will be more readily understood and appreciated by reference to the detailed description of the embodiments and the drawings.

DETAILED DESCRIPTION OF THE CURRENT EMBODIMENTS

I. Overview

Figure 1:
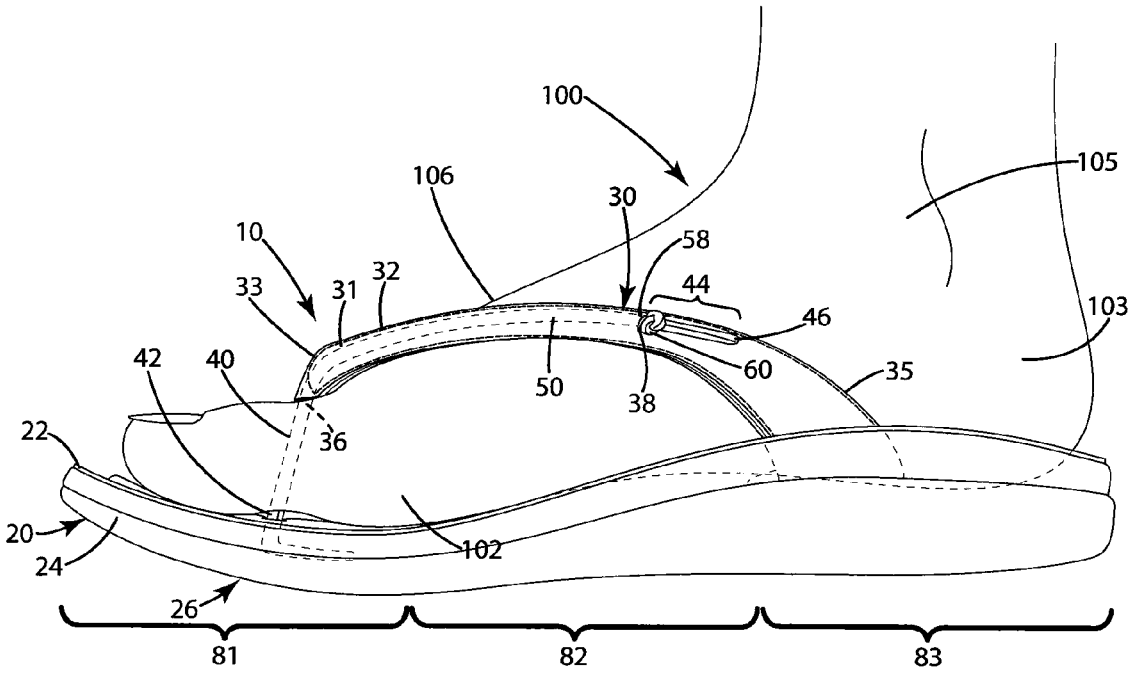
FIG. 1 is a side view of a current embodiment of the footwear.
Figure 2:
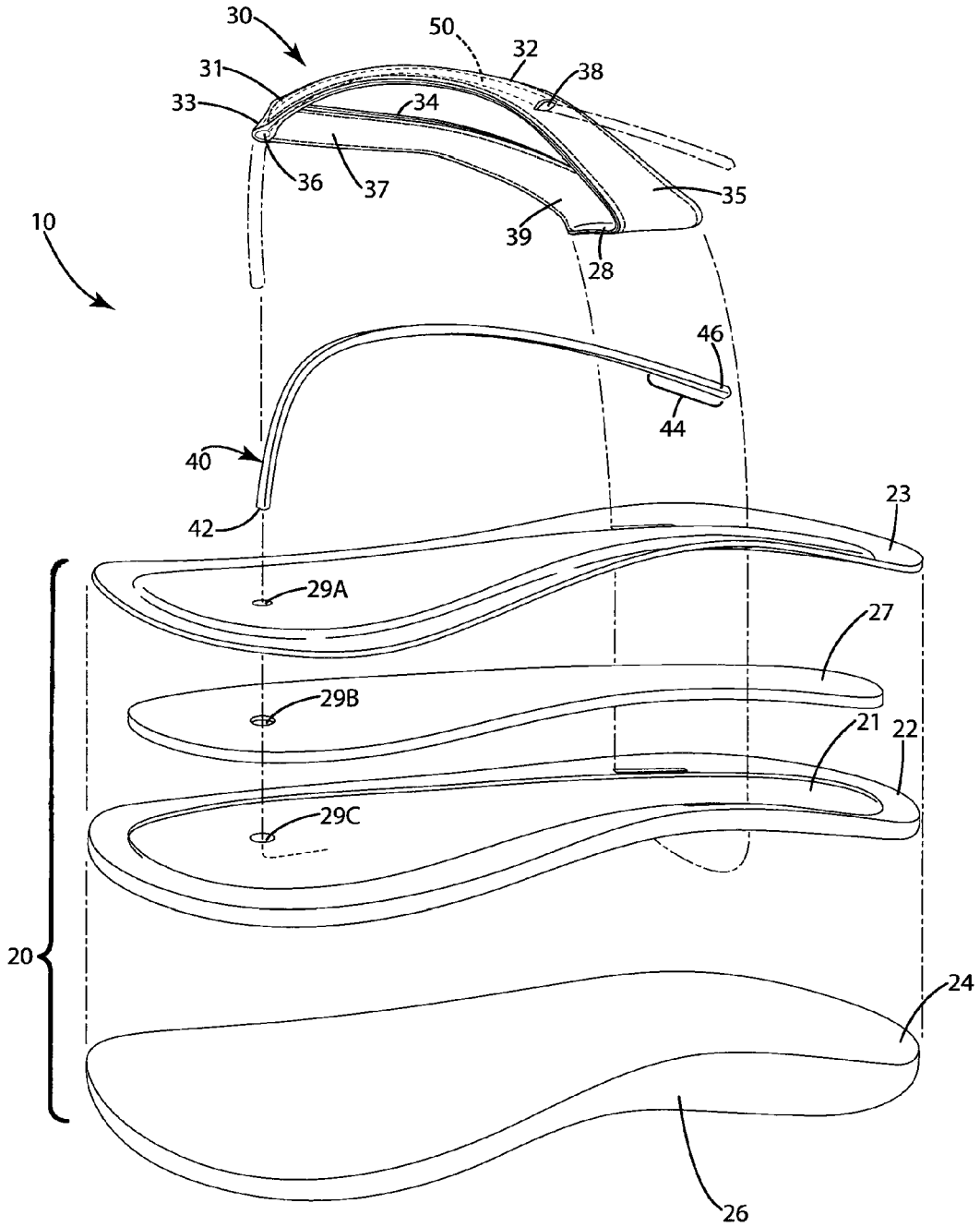
FIG. 2 is an exploded perspective view of the footwear.
Figure 3:
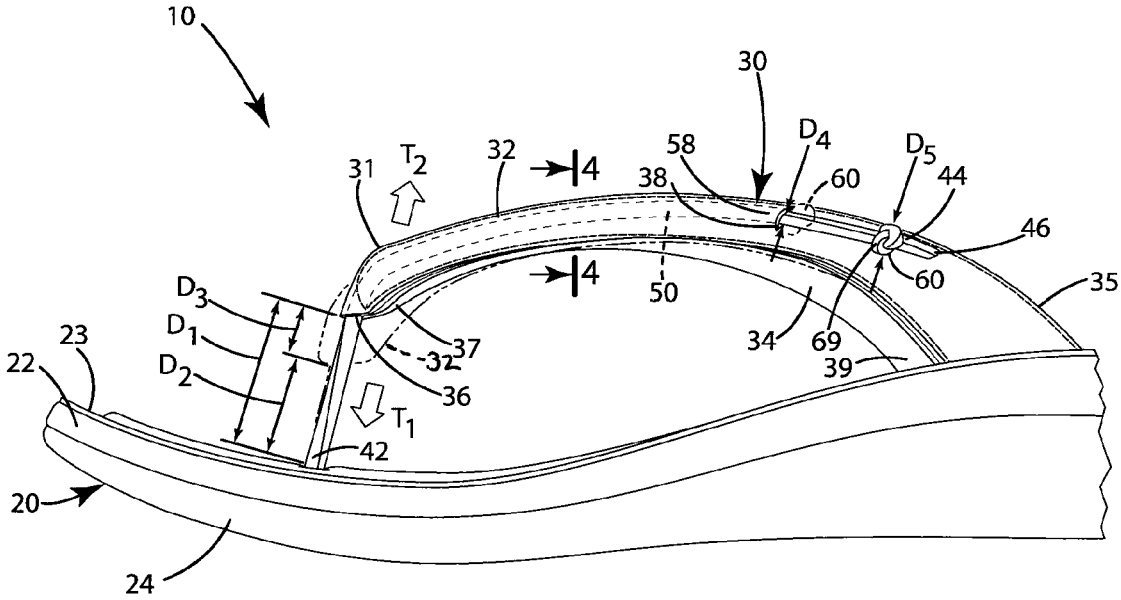
FIG. 3 is an enlarged side view of the footwear being adjusted to a second configuration.

Footwear constructed in accordance with a current embodiment is illustrated in FIGS. 1-3 and generally designated 10. The footwear 10 includes an upper 30 joined with a sole 20. The upper includes first and second straps 32, 34. The first strap 32 can define a sleeve 50. A cord 40 can extend from a portion of the sole 20 upward through the sleeve 50, and can include a part 44 that extends beyond the sleeve. An adjustment element 60 can be joined with cord part 44. The adjustment element 60 can regulate the amount of cord fed into the sleeve, and subsequently the distance between the strap and the sole portion relative to the features of a wearer's foot. By moving the adjustment element 60 along the cord part 44, the distance between that cord part 44 relative to the distal or first end 42 of the cord 40 can be adjusted. In turn, this can enable a wearer to selectively adjust fitment of the strap on the wearer's foot and provide a desired dimension of the upper 30. This can provide personalized comfort and fit of the footwear on the wearer's foot.

For purposes of disclosure, the embodiments herein are described in connection with a sandal or casual footwear. As will be appreciated, the embodiments also are well suited for any other type of footwear including athletic footwear, work footwear, outdoor footwear, walking footwear and multi-sport footwear. Further, as used herein, the term "arch region" (or arch portion) refers generally to the portion of the footwear corresponding to the arch of the wearer's foot; the term "forefoot region" (or forefoot portion) refers generally to the portion of the footwear forward of the arch region corresponding to the forefoot (e.g., including the ball and the toes) of a wearer's foot; and the term "heel region" (or heel portion) refers generally to that portion of the footwear rearward of the arch region corresponding to the heel of the wearer's foot. The forefoot region 81, arch region 82 and heel region 83 are generally identified in FIG. 1, however, it is to be understood that delineation of these regions may vary depending upon the configuration of the footwear.

II. Structure

The components of the footwear 10, also referred to as a sandal for purposes of describing the embodiments herein, will now be described in more detail. As shown in FIGS. 1 and 2, the upper 30 can include straps 32 and 34 which can be separate or integral components. These straps 32, 34 can extend forward from the arch region 82 or the heel region 83 of the footwear generally toward the forefoot region 81. The straps 32, 34 can be joined at a junction 33 which is adapted to be positioned over the top 106 of the forefoot of the wearer's foot in the forefoot region 81 when the sandal is positioned on the wearer's foot 100.

Although shown as only including first 32 and second 34 straps, the sandal can include multiple straps extending within, from and to multiple different regions of the footwear. For example, the straps might start and end in any one of the forefront, arch and heel regions. As a further example, the straps can extend rearward around the heel region 83 of the footwear to circumferentiate at least a portion of the wearer's ankle 105 and/or heel 103.

The straps 32, 34 also can be of varying dimension. For example, although shown as being generally elongate members, the straps can be wider, more resembling a wide flap or flat portion of the upper 30. The straps also can be rectangular or curved as shown. Alternatively, the straps can be of a triangular shape, with the cord (as explained below) extending from a point, center or other portion of the triangular shape as desired.

Although not shown in FIGS. 1-3, the upper 30 can include a heel strap that extends from the medial and lateral portions of the wearer's foot to wrap around the rear of the wearer's heel 103 or Achilles tendon to provide additional securement of the footwear to the wearer's foot. The heel strap may or may not include a sleeve and associated cord as desired.

Further, although shown as an open toe sandal, the footwear 10 can be a closed toe sandal which completely houses the toes of the wearer. In such construction, the sandal can include a toe cap that extends upwardly from the midsole or outsole over the toes of the wearer to protect the wearer's toes. The one or more straps may or may not be joined with the toe cap as desired.

The sandal as illustrated in FIGS. 1-3 also can include a sole 20 having a midsole 22, an outsole 24, a cushion 27 and a cover 23, which may be constructed from the same or different materials, and which may be of a single monolithic structure or which may be separate, independent components. When separate components, the midsole 30 can be constructed from resilient and semi-rigid yet shock-absorbing synthetic material, for example, polyurethane. Polyurethane is generally well known in the footwear industry. Therefore, it will not be described in detail here. The rigidity and flexibility of the polyurethane can be varied from application to application as desired using a variety of well known techniques, such as adjusting the type, proportion and amount of the reactant to make up the material. In addition, the rigidity and flexibility of the polyurethane can be varied by adjusting the volume of polyurethane material used. Although polyurethane is one optional midsole material, the density and precise chemical makeup of the midsole material can vary depending on a variety of factors including the size of the midsole, and the desired cushioning and flexibility characteristics of the footwear.

The outsole 24 can be constructed from a relatively hard but gripping rubber or other sufficiently durable and wear-resistant material. The outsole 24 includes a bottom 26 that forms a wearing surface of the outsole and may be contoured to define a desired tread pattern. The bottom 26 can also be textured to improve the traction and the feel of sandal. The outsole 24 and midsole 22 can be joined with one another with cement, stitching, or directly attach construction techniques.

The sole 20 also can include a cover 23, which can generally cover the midsole 22 and cushion 23, and can form the interface between the sole 20 and the wearer's foot. The cover 23 can be constructed from a single uniform layer of leather or synthetic or other material, and can be contoured to follow the contours of the wearer's foot. If desired, a cushion 23 can be placed and secured within a recess 21 defined by the midsole 22. The cover 23 can extend over the cushion and the midsole portions to form a perimeter of the recess 21. The cover can be glued, cemented or otherwise attached over these components. Of course, if desired, the sole can be a single unitary element with the midsole 22, with the separate cushion, cushion recess and/or cover eliminated.

The sole and its various components can extend from a medial side of the footwear to the lateral side of the footwear, across a width of the footwear. The sole and its components also can extend from the forward most portion of the footwear to the rearward most portion of the footwear, or generally from toe to heel of the footwear.

Returning to FIGS. 2 and 3, the first strap 32 can include a first strap forward portion 31 and first strap rearward portion 35. The second strap 34 can include a second strap forward portion 37 and a second strap rearward portion 39. The first strap forward portion 31 can extend rearwardly from a junction 33 at which the first and second straps meet or overlap or are joined or are near one another, along the top 106 of the wearer's foot 100 and then transition to extend along a medial side 102 of the wearer's foot 100. Although shown as joining with the sole 20 in the arch region 82, the first strap rearward portion 35 can be joined with the sole 20 in the arch region and/or the heel region, or even the forefoot region 81 of the footwear. Further, the first strap rearward portion 35 can extend around the heel region 83 (around the heel of the foot) and rejoin on the opposite side of the foot with the second strap if desired.

The second strap can form another portion of the upper 30, and as mentioned above, the second strap can include a forward portion 37 and a rearward portion 39. The forward portion can be joined with or near the first strap 32 at the junction 33. The second strap rearward portion 39 can extend generally forwardly from the arch region 82 (or other regions as described in connection with the first strap) along the lateral side 102 of the wearer's foot. The second strap forward portion 37 can also extend over a portion of the top 106 of the wearer's foot.

Figure 4:
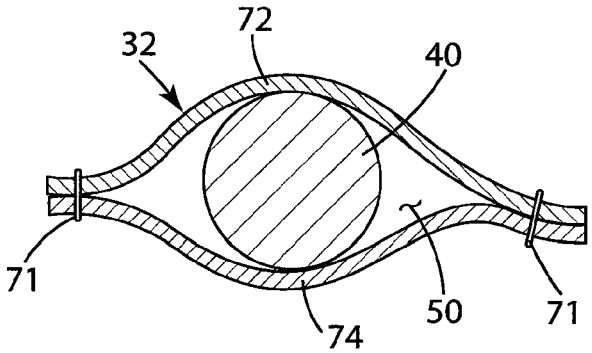
FIG. 4 is a sectional view taken along lines 4-4 in FIG. 3.

As shown in FIGS. 2-4, the first strap 32 can define a sleeve 50. If desired, the second strap 34 or other parts of the upper 30 or sole 20 can optionally define one or more sleeves. The sleeve 50 can be defined and can extend between a first aperture 36 and a second aperture 38, which is located a distance from the first aperture 36. The sleeve can be of a variety of dimensions. As illustrated, the sleeve is approximately 3 to 4 inches in length and extends from the junction 33 generally toward the arch region 82. The length and location, however, may vary and may be anywhere from ½ inch to 5, 6, 7, or more, or fewer, inches if desired.

As shown in FIG. 4, the sleeve can be generally defined between first 72 and second 74 pieces or panels of material that are stitched together with stitching 71 along the edges of the pieces. The middle portion 72 between the edges being free to form the sleeve 50. The material from which the straps, and at least part of the sleeve, are constructed can be a natural or synthetic leather, fabric, canvas, neoprene, plastic, composites, metal or other materials.

Although not shown, the sleeve can be lined with a material to enable the cord 40 to slide or move more or less easily relative to the sleeve and corresponding strap. Further, although shown as being defined between pieces of the strap 32, the sleeve 50 can also be defined by a tubular structure simply joined with the strap 32. The tubular structure can be in the form of a tube of a dimension slightly larger than the dimension of the cord, and configured to extend along a portion of the strap. As an example, the tube can be a plastic tube that is simply stitched, glued or cemented to the interior or exterior of one or more of the straps 32 or 34, or other component of the upper 30 or sole 20.

As shown in FIG. 3 and explained above, the sleeve 50 generally extends from a first aperture 36 to a second aperture 38. Between the first and second apertures, the cord 40 housed within the sleeve can be generally concealed from view to a viewer of the footwear 10. Alternatively, as shown in the alternative embodiment of FIG. 5, the sleeve can be discontinuous so that a portion 153 of the sleeve is open, thereby exposing a portion of the cord 140 between portions 152, 154 of the sleeve. Specifically, the sleeve 150 includes first sleeve member 152 and second sleeve member 154. The edges of the sleeve members are generally stitched down with stitching 171 to the underlying strap 132. Alternatively, the sleeve members 152 and 154 can be glued, stapled or otherwise fastened to the underlying strap, or simply formed in the strap 132 with the cord extending between the respective slits effectively between the sleeve members 152 and 154. Regardless of the sleeve member construction, the cord 140 can be visible to a viewer in the exposed region 153. An adjustment element 160, illustrated as a lock 160, can be positioned on the cord 140 as described in further detail below to limit movement of the cord 140 relative to the sleeve 150 and thereby provide suitable adjustment for dimensions of the footwear.

Returning to the current embodiment shown in FIGS. 1-4, the cord can be in the form of an elongate member that extends from one portion of the footwear to another portion of the footwear and generally joins two different portions of the footwear. The cord can be constructed from leather, canvas, filaments, fibers, a tube, lace, or any other suitable material. Although shown as having a generally cylindrical cross section, the cord can be of a square, rectangular, elliptical, triangular, hexagonal, or other geometric cross section. Further, as used herein, the term "cord" also can include any elongated element, for example, a rope, a lace, a braided element, a cable, a band, or other suitable elongated member.

The cord 40 can generally include a first end 42 and a second end 46. The first end 42 can be joined with an upper and/or sole portion of the footwear 10. As illustrated in FIGS. 1 and 2, the first end 42 of the cord 40 can be joined with the sole 20. The precise positioning of the cord 40 can be such that it extends upwardly from the sole 20 and is designed to generally fit between adjacent toes of the wearer, for example, the first and second toes of the wearer measured from the medial side of the foot. The first end 42 can be joined with the midsole 22. This joining can be accomplished by gluing the extreme end 42 to the underside of the cushion 23 and sandwiching that extremity between the midsole 22 and the cushion 23. Alternatively, a cap or button can be pinched onto or otherwise joined with the end 42 of the cord 40. This cap can be sandwiched between adjacent elements of the sole 20 to capture the end and prevent it from moving relative to the sole, or simply glued or molded to one or more components of the sole 20.

The cord 40 as illustrated can extend upwardly, away from the sole and generally through the sleeve 50. More specifically, the cord can pass through the first aperture 36, through the sleeve 50 and out the second aperture 38. Depending on the construction of the sleeve, the cord 40 can be concealed or partially exposed while positioned in the sleeve, as explained above. The cord can be sized slightly smaller than the apertures 36 and 38 to provide relative movement thereto. Alternatively, the apertures 36 and 38 can be almost the same dimensions as the cord so that it provides a friction fit and the sleeve likewise frictionally engages the cord.

As illustrated, the first aperture 36 can be defined at the junction 33 of the first and second straps. Optionally, the first aperture can be defined more rearwardly on the footwear, for example, on the medial or lateral sides of the foot. Further optionally, the first aperture can be defined anywhere on the upper 30 or other component of the footwear depending on the footwear portions that are desired to be adjusted. The rearward aperture 38 can be defined in the arch region and/or heel region 82, 83 of the footwear, and by the respective strap. Of course, depending on the dimension desired to be adjusted, the second aperture can be defined somewhere else on the upper or other component of the footwear.

As shown, with the cord 40 being of an optional fixed length, the part 44 of the cord that extends beyond the sleeve can vary depending directly on the amount of cord between the upper and/or sole portion and the strap 32. This variance can correlate directly to the internal dimension of the footwear by the upper. Indirectly, the internal dimension(s) of the footwear can be dictated by the part 44 of the cord extending beyond the sleeve. The cord 40 is generally positioned within the sleeve 50 so that it can slide or otherwise move relative to the sleeve 50 and/or strap to adjust the tension of the cord extending between the strap 32 and the sole 20 when a user's foot is placed in the footwear.

The cord in use can generally be under a certain amount of tension T1, as it is the portion of the footwear that pulls or holds the straps 32, 34 over the foot 100, and generally secures the footwear to the foot 100. The amount of tension T1 in the cord can vary, but optionally can be about 0.1 to about 15 pounds, further optionally, 1 pound to 6 pounds, or some other poundage, depending on the application.

The cord 40 generally extends between and joins the sole 20 and the strap 32. Although shown as separated by a space, the strap 32 optionally can extend down to the sole 20 if desired. Further, as illustrated, the spatial relationship between the strap and the sole is such that the strap 32 is spaced a distance D1 from the sole 20 that a gap or other open space is located between these elements. In other constructions, the spatial relationship between the respective strap and the sole portion and/or other portions of the upper, can be such that the strap overlays or overlaps that other element. In both of the foregoing constructions, the cord and adjustment element can be used to arrange the strap and upper and/or sole portion in a preselected spatial arrangement as desired by the wearer of the footwear, in the manner described herein. In the example where the strap overlaps another portion of the upper and/or sole, the cord and adjustment element can still be utilized to further provide more or less of an overlap of the relative components, and thereby adjust the dimensions of the footwear to the references of the wearer. In another example, where the strap is separated from the upper and/or sole portion, the cord and adjustment element can be used to adjust the dimension of the gap between the components and in some cases cause the components to overlap more or less.

After sliding the cord the desired amount and thereby adjusting the dimensions of the footwear and the spatial relationship between the strap 32 and the sole 20, the cord can be held or secured in a fixed configuration relative to the strap. This can be accomplished with the adjustment element 60. As shown in FIGS. 1-3, the adjustment element can be in the form of a square knot tied in the cord 40. This knot 60 can be of a dimension that is slightly larger than the second aperture 38 so that the knot 60 does not slide substantially into or through the sleeve 50. This is better understood with reference to FIG. 3. There, the dimension of the aperture 38 is illustrated as D4. The minimum dimension of the knot is illustrated as dimension D5. Dimension D5 can be greater than dimension D4. Accordingly, the adjustment element 60, again in the form of a knot, will not slide into the sleeve or through the aperture 38.

With the adjustment element 60 engaging the boundary 58 of the sleeve of the aperture 38, the distance D1 between the strap 32 and sole 20 does not readily decrease. By placing the adjustment element 60 at a preselected location along the part 44 of the cord, the cord 40 can establish a preselected length between that part 44 of the cord and the first end 42 of the cord. For example, due to the material surrounding the aperture 38 abutting against the adjustment element 60, the strap 32 will not move beyond a desired distance D1 from the sole. This distance D1 can correspond to an internal dimension of the footwear that provides a comfortable fit of the footwear on the wearer's foot.

As explained with reference to the adjustment element 60, in the locked mode, the adjustment element 60 can be generally immovable relative to the cord 40. When the tension T1 (as shown in FIG. 3) is placed in the cord 40, and/or when force T2 is placed on the strap, the adjustment element 60 allows the cord 40 to move relative to the sleeve and/or strap until the sleeve engagement surface 69 of the adjustment element 60 engages the boundary 58 of the sleeve, at which point, the engagement of these elements prevents and/or impairs further movement of the strap 32 away from the sole 20 or other portion. Of course, if the sleeve engagement surface 69 is already abutted against the boundary of the sleeve, then the tension T1 or force T2 will not impart movement of the cord relative to the sleeve and/or strap.

As shown in FIG. 3 and mentioned above, the adjustment element 60 is adapted to abut the material surrounding the second aperture 38 of the strap 32, also referred to as the boundary 58 of the sleeve. Optionally, there is no other adjustment element adjacent the first aperture 36. Therefore, the cord 40 can move so that the second end 46 of the cord moves away from the second aperture 38. In this manner, the length of the cord D1 between the sole 20 and the strap 32 may decrease, particularly if a user's foot is not placed in the footwear 10. Accordingly, the adjustment element 60 can prevent the internal or other dimension of footwear from becoming larger, but might not prevent the internal or other dimension of the footwear from becoming smaller.

Put another way, the adjustment element 60 will not prevent the cord 40 from sliding or moving relative to the sleeve 50 so that the distance D1 between the sleeve 50, or strap 32 and the first cord end 42 decreases, however, the adjustment element 60 will prevent the cord 40 from sliding or moving relative to the sleeve 50 so that the distance D1 between the sleeve 50 or strap 32 and the first cord end 42 increases, particularly when the adjustment element 60 engages the sleeve and/or strap as shown in phantom in FIG. 3. This functionality can be acceptable because the space between the strap and sole 20 is generally filled by the wearer's foot 100 so that the distance D1 is restricted from decreasing due to the wearer's foot preventing movement between the strap 32 and the sole 20. If desired, however, a second adjustment element 60 can be placed adjacent the first aperture 36 to prevent or impair any decrease in the distance D1.

Although shown in the current embodiment of FIGS. 1-3 as a knot, the adjustment element 60 can be of a variety of configurations. In general, the adjustment element 60 can generally be in the form of some sort of object joined with a cord 40. The object can be of a dimension that is generally larger than the dimension of the second aperture 38 so that the object will not allow the cord 40 to slip or slide relative to the sleeve any further than the object.

Figure 5:
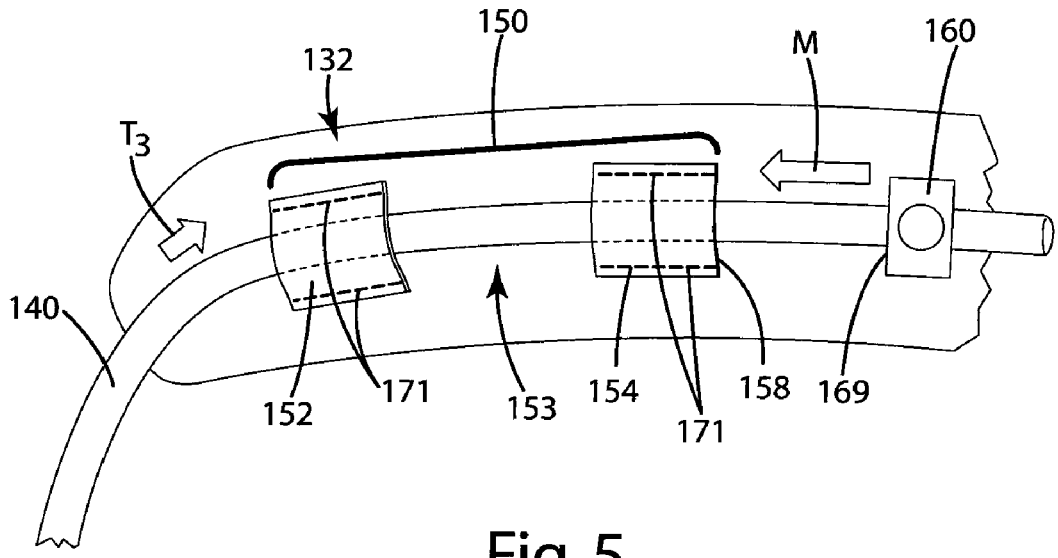
FIG. 5 is an enlarged view of the first alternative embodiment of a portion of the footwear.
Figure 6:
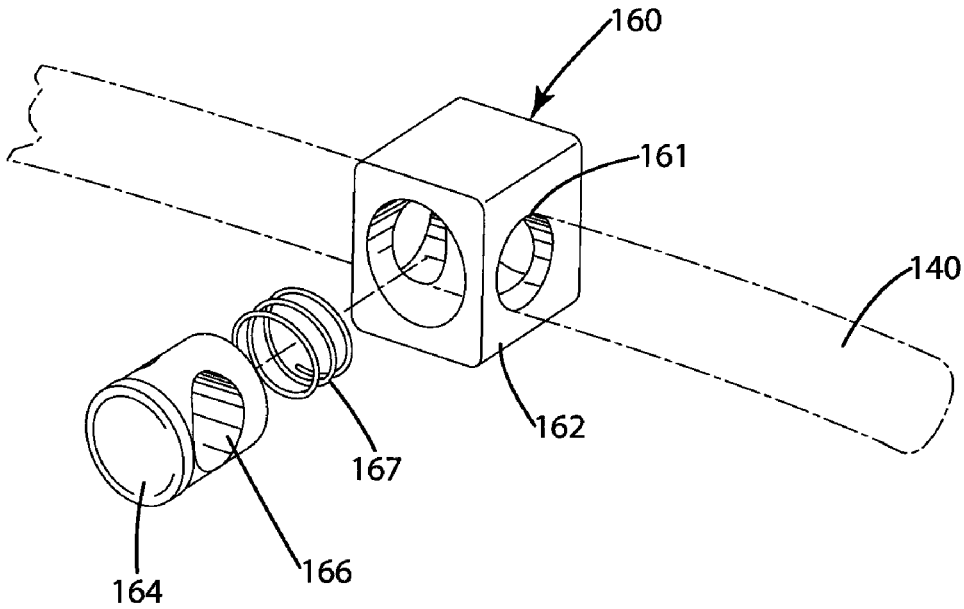
FIG. 6 is an exploded view of an adjustment element engaging a cord of the first alternative embodiment of the footwear.

One alternative adjustment element is illustrated in FIGS. 5 and 6. There, the adjustment element is in the form of a locking element, such as a lock 160 that can be joined with the cord 140. In general, the lock is operable between a locked mode and an unlocked mode. In the locked mode, the lock 160 engages the cord so that the lock will not move relative to the cord. In the unlocked mode, the lock can be manually operated, or operated with a tool, and can slide along the cord 140 to a preselected location on the cord 140.

The lock 160 generally includes a housing 162. The housing can define an aperture 161 through which the cord projects. The housing 162 can also house a button or other moveable or depressible element 164 that is actuatable by a biasing element 167, which as illustrated, is in the form of a coil spring. The biasing element, however, can be of a variety of other than biasing elements, such as a compressible spring, a leaf spring or another type of spring. The button 164 can include an engagement surface 166 that engages a surface or other portion of the cord 140. The engagement surface 166 can be in the form of the internal surface of a bore defined in the button 164.

When the button is depressed by a user, the engagement surface 166 at least partially disengages the corresponding surface of the cord 140 and transitions from a locked mode to an unlocked mode. In the unlocked mode, the user can slide or otherwise move the lock relative to the cord 140. To relock the lock element 160 relative to the cord 140 or put the element in a locked mode, the user removes the force from the button and the bias element 167 urges the button 164 so that the engagement surface 166 frictionally engages the cord 140.

Like the embodiment described above, in the locked mode, the adjustment element 160 is generally immovable relative to the cord 140. Accordingly, when the force T3 as shown in FIG. 5 is placed on the sleeve 132, the adjustment element 160 allows the sleeve 150 to move relative to the cord to move in direction M (which is relative to the strap 132) until the sleeve engagement surface 169 of the adjustment element 169 engages the boundary 158 of the sleeve, at which point the engagement of these elements prevents and/or impairs further movement of the strap 132 in the direction of the arrow T3 in which the force is applied.

Optionally, the adjustment elements above its components can be constructed from plastic, metal, composites, or other materials as desired. Further optionally, the above described adjustment elements can be substituted with virtually any mechanism or construction that engages the cord and subsequently is immoveable relative to the cord.

III. Manufacture

Manufacture of the footwear 10 of the current embodiment will now be described with reference to FIGS. 1-4. The manufacture of the other embodiments described herein is similar to the construction of the current embodiment. In general, the sole 20 components, such as the outsole 24 and the midsole 22 can be formed using conventional techniques such as injection molding. These components can be allowed to cure, and then trimmed and cleaned with a suitable cleaning agent.

Wherein included, the recess 27 can be pre-molded in the midsole or the material corresponding to the recess can be removed from the midsole 22. With the recess formed, the cushion 21, which can be preformed, can be inserted into the recess and optionally glued therein. The cover 23 can be placed over the recess and glued, cemented or otherwise joined with the top of the cushion 27 in the boundary of the midsole 22 surrounding the recess 27.

The straps 32, 34 of the upper 30 can be formed using conventional cutting and stitching techniques from available materials. The sleeve 50 of the respective strap or straps can be constructed by sewing together edge-to-edge opposing pieces of material 72 and 74 with stitching 71 as illustrated in FIG. 4. The finished sleeve 50 can be of a desired configuration and dimension to accommodate the cord 40. Of course, alternatively, the other types of sleeve constructions can be joined with a piece of material forming the respective strap(s) as described above.

The upper 30 also can be joined with the sole 20. For example, where the straps 32 and 34 are joined with one another at a cross member 28, the cross member 28 can be positioned between the cushion 24 and the midsole 22 to capture that cross member. These respective components of the upper and sole can be joined together with glue, stitching or other fastening techniques. The cord end 42 can be extended through the holes 29*a*, defined by the cover, the hole 29*b* defined by the cushion 27, and the hole 29*c* defined by the midsole of the sole 20 as illustrated in FIG. 2. The end 42 of the cord 42 can be glued, tacked, stapled or stitched to the cushion 23, the midsole 22 and/or the cover 23, but as shown can be adhered to the underside of the midsole. Alternatively, the cord 40 can be anchored to the sole 20 by using an anchor (not shown) attached to the first end 42 of the cord 40.

The cord can be extended toward the strap 32 and in particular, the sleeve 50 defined by the strap. Optionally, the cord 40 can be positioned so that it extends upwardly from the sole in a location that is adapted to be placed between adjacent toes of the wearer. The cord can further be extended or positioned in the sleeve 50 so that the cord 40 is slidable in the sleeve. The cord 40 can be further slid through the sleeve 50 so that part 44 of the cord 40 extends beyond the sleeve 50. In this configuration, the second end 46 of the cord can be exposed beyond the sleeve, along with a part 44 of the cord.

An adjustment element 60 can be positioned along the part 44 of the cord extending beyond the sleeve 50. Where the adjustment element 60 is a knot (FIG. 1), the knot can be tied in the cord 40. Where the adjustment element 60 is a lock (FIG. 6), the lock can be slid over the free end of the cord and placed somewhere along the part 44 of the cord adjacent the free end, but located beyond the sleeve 50 and the aperture 38. The adjustment element can be moved to a predetermined location along the part 44 of the cord 40 to establish a preselected length of the cord between the part of the cord and the first end of the cord that is joined with the sole. The adjustable element 60 can be locked in place so that the portion of the strap, such as the sleeve boundary 58, or material near the aperture 38, or other component abuts the adjustment element 60 adjacent the second aperture 38 or the end of the sleeve 50, which in turn prevents relative movement of the strap 32, the sleeve 50 and/or the upper 30 in relation to the sole 20. In turn, this causes the upper and specifically the strap to engage the wearer's foot to retain the footwear 10 on the wearer's foot.

One example of adjusting a dimension of the footwear is illustrated in FIG. 3. There, the distance D1 between the strap 32 and the sole 20 is increased from D2 to D1. This can be effected by loosening the adjustment element 60 shown in phantom lines and moving it to the position along the part of the cord 44 as shown in full lines. With this movement, a force T2 can be placed on the strap 32 to raise the strap and move it away from the sole 20 from the position shown in phantom lines to the position shown in full lines. This results in an increase in the distance between the strap 32 and/or sleeve 50, and the sole 20 equivalent to the distance D3. With this increase in distance, the internal dimensions of the upper 30 are effectively increased.

Another example, in which a dimension of the footwear is decreased, is achieved by reversing the above steps. As shown in FIG. 3, in this example, the strap 32 shown in full lines is moved to the position corresponding to the strap 32 shown in phantom lines by reversing the direction of force T2. The adjustment element 60 shown in full lines is selectively relocated to the location shown in phantom lines. This reduces the distance D1 by the distance D3. Accordingly, the resulting distance between the strap 32 and/or sleeve 50 and the sole 20 is reduced to distance D2, and the internal dimension of the upper 30 and generally the footwear 10 can be reduced. In both of the above examples, the preselected location of the adjustment element can establish a preselected length of the cord 40 between the part 44 of the cord and the first end 42 of the cord, which in turn positions the strap in a predetermined spatial relationship relative to the sole. Of course, if the cord is connected to another portion of the upper, a preselected spatial relationship could be established between it and the strap as well.

IV. Second Alternative Embodiment

Figure 7:
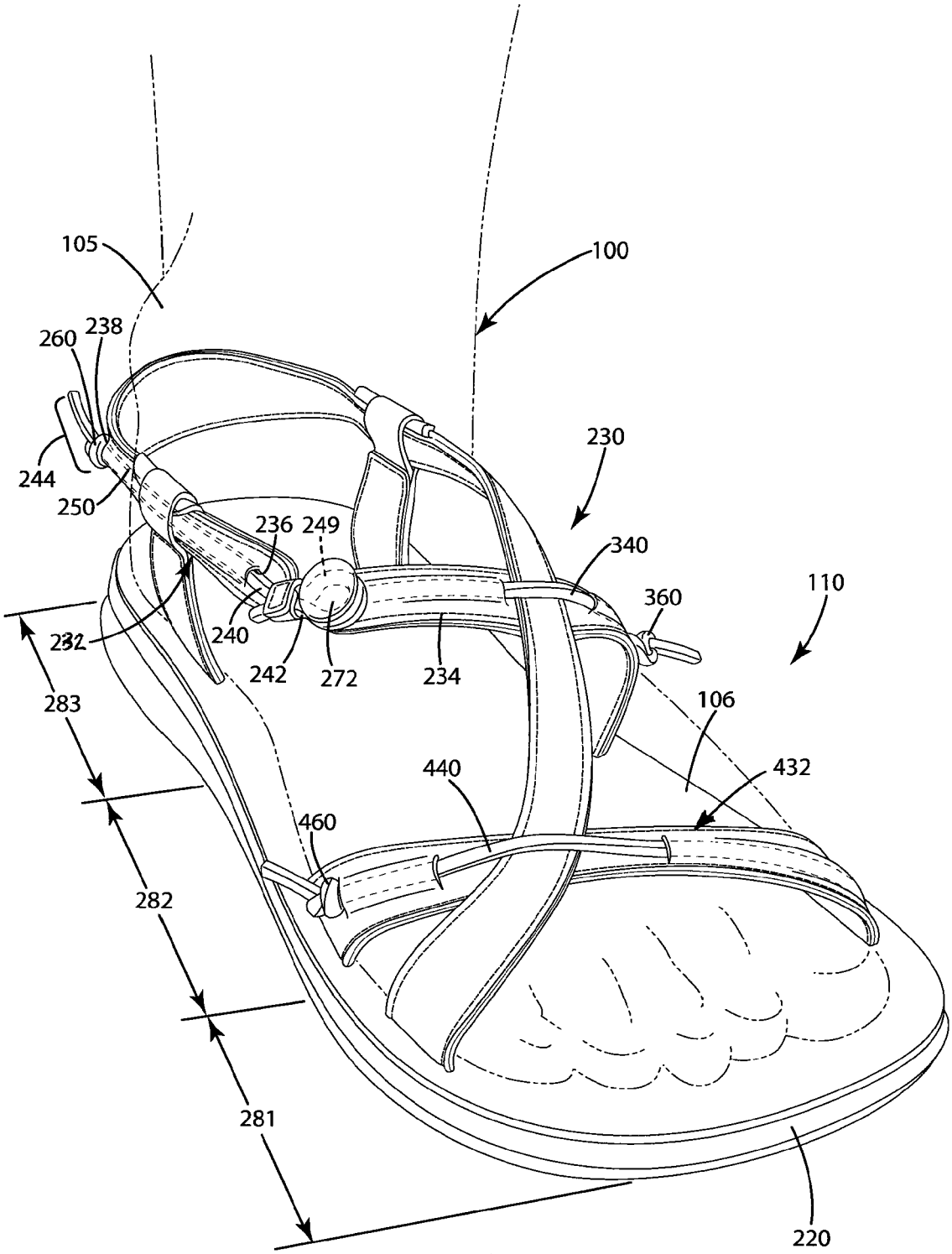
FIG. 7 is a side perspective view of a second alternative embodiment of the footwear.

A second alternative embodiment of the footwear is illustrated in FIG. 7 and generally designated 110. This embodiment is similar in construction and operation to the embodiments above with several exceptions. For example, the footwear 110 is in the form of a sandal including multiple straps. The straps extend in a variety of configurations and orientations over different portions of the foot and the ankle. The strap 232 forms a portion of the upper 230 of the sandal. The strap 232 extends from the forefoot region 281 through an arch region 282 around the heel region 283 and is adapted to a circumferentiate at least a portion of the user's ankle 105. The strap 232 is spaced a distance from a second strap 234 of the upper 230. The strap 232 can define a sleeve 250 which is similar to the sleeve as described above, with corresponding first and second apertures 236 and 238. The footwear can also include a cord 240 and an adjustment element 260 such as those described in the embodiments above. The first end 242 of the cord, however is attached via a fastener 272 to the second strap 234. As will be appreciated, although shown as a strap, the second strap 234 can simply be a large second portion of the upper 230, and need not be in a strap-like configuration. The cord 240 can be positioned so that it is adapted to wrap at least partially around an ankle 105 of the wearer's foot 100.

The cord 240 extends from the fastener 272 through the sleeve in a similar configuration as the current embodiments above. The cord 240 can be selectively slid within the sleeve to adjust the spacing between the first and the second strap, much like the distance D1 (FIG. 3) between the upper 230 and sole 220 are modified in the current embodiments above. Likewise, the adjustment element 260 can be selectively positioned along the part 244 of the cord 240 which extend beyond the sleeve 250 to provide a desired fit adjustment.

Optionally, as shown, the first end 242 of the cord 240 can include a loop 249 that loops over the fastener 272 to selectively fasten that end of the cord to the second strap 234. In this manner, the loop 249 optionally can be removed from the fastener 272 to unhook the cord 240 from the fastener. With this removal and disconnection, the first strap 232 can be opened relative to the ankle. Reversing this order of operation, the strap 232 can be re-attached to the second strap, to close the ankle and secure the footwear to the ankle with the straps 232 and 234.

As illustrated in FIG. 7, another cord 340 and adjustment element 360 as described herein can also be incorporated into the second strap 234. As shown there, the cord 340 can be slidable in the corresponding sleeve 350 and can provide spatial adjustment of the fastener 272 relative to the second strap 234 and/or the first strap 232. The cord and adjustment element of this embodiment can operate in a manner similar to the embodiments above. Another portion of the upper 230 can include a strap 432 which includes a cord 440 and a corresponding adjustment element 460. This particular strap 432 extends from a medial side to a lateral side of the footwear generally across the top 106 of the wearer's foot 100 in the forefoot region 281 of the footwear. By adjusting the location of the adjustment element 460 relative to the cord, the strap can be tightened or loosened relative in the forefoot region 281 to provide a desired fit on the forefoot. The other strap configurations shown in FIG. 7 illustrate the variety of locations in which the cord, adjustment element and other components can be incorporated into footwear. Again, these features can operate in a manner similar to the embodiments described above.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A footwear construction comprising:

an upper;

a sole joined with the upper;

a strap extending in a forefoot region of the footwear and forming at least a portion of the upper, the strap defining a sleeve;

a cord including a first end and a second end, the first end joined with the sole, the cord extending upwardly from the sole, the cord adapted to be positioned between adjacent toes of the wearer's foot, the cord being selectively slidably housed in the sleeve, the cord joining the upper and the sole in a forefoot region of the footwear; and an adjustment element selectively locatable along a part of the cord to establish a preselected length of the cord between the part of the cord and the first end of the cord, wherein the first strap engages the wearer's forefoot to retain the footwear on the wearer's foot.

2. The footwear construction of claim 1 wherein the sleeve defines a first aperture and a second aperture, the first aperture being closer to the first end of the cord than the second aperture, wherein the sleeve at least partially conceals the cord therein between the first aperture and the second aperture.

3. The footwear construction of claim 2 wherein the sleeve defines a third aperture between the first aperture and the second aperture, wherein the cord is visible to a viewer through the third aperture.

4. The footwear construction of claim 1 wherein the adjustment element is a knot tied in the cord.

5. The footwear construction of claim 1 wherein the adjustment element is a lock joined with the cord, the lock operable between a locked mode, in which the lock is immoveable relative to the cord, and an unlocked mode, in which the lock is adapted to move along the cord.

6. The footwear construction of claim 1 comprising a second strap joined with the first strap at a junction, the junction adapted to be positioned above the top of a wearer's forefoot, the cord being at least partially disposed forwardly relative to the junction, the cord extending rearward generally from the forefoot region toward a heel region of the footwear.

7. A footwear construction including a forefoot region, an arch region and a heel region, the footwear construction comprising:

an upper in the form of a sandal;

a sole joined with the upper;

a first strap forming a portion of the upper and extending forwardly from at least one of the arch region and the heel region of the footwear, the first strap including a first strap forward portion and a first strap rearward portion, the first strap rearward portion adapted to extend along a medial side of a wearer's foot, the first strap forward portion adapted to extend over at least a portion of a top of the wearer's forefoot, a second strap forming another portion of the upper and extending forwardly from at least one of the arch region and the heel region of the footwear, the second strap including a second strap forward portion and a second strap rearward portion, the second strap rearward portion adapted to extend along a lateral side of a wearer's foot, the second strap forward portion adapted to extend over at least another portion of the top of the wearer's forefoot, the second strap forward portion joining with the first strap forward portion at a junction, wherein at least one of the first strap and the second strap define a sleeve extending from a first aperture, defined in at least one of the junction, the first strap forward portion and the second strap forward portion, toward a second aperture, defined in at least one of the first strap rearward portion and the second strap rearward portion distal from the junction, a cord including a first end and a second end, the first end joined with the sole, the cord extending upwardly from the sole, the cord adapted to be positioned between at least two adjacent toes of the wearer's foot, the cord entering the first aperture and exiting the second aperture, the cord being at least partially housed in the sleeve, the cord second end being at least partially exposed beyond the second aperture; and an adjustment element adapted to be located at a predetermined part of the cord second end, the adjustment element, when located at the predetermined part, adapted to prevent the cord second end from sliding through the sleeve, the adjustment element adapted to engage at least one of the first strap and the second strap to establish a preselected length of the cord between the predetermined part and the first end, whereby the at least one of the first strap and the second strap engages at least one of the lateral, medial and top of the wearer's foot to secure the upper to the wearer's foot.

8. The footwear construction of claim 7 wherein the adjustment element is a knot tied in the second end of the cord, the knot adapted to abut against the at least one of the first strap and second strap adjacent the second aperture when the cord is under tension.

9. The footwear construction of claim 7 wherein the adjustment element includes an object joined with the cord, the object being of a first dimension that is larger than a second dimension of the second aperture.

10. The footwear construction of claim 7 wherein the adjustment element is a lock including and engagement surface and a biasing element that presses the engagement surface against the cord.

11. The footwear construction of claim 7 wherein the first aperture is defined in the junction of the first and second straps, and wherein the second aperture is defined in at least one of the arch region and a heel region of the footwear.

12. A footwear construction comprising:

an upper including an upper portion;

a sole joined with the upper, the sole including a sole portion;

a strap defining a sleeve, the strap spaced from at least one of the upper portion and the sole portion, a cord including a first end and a second end, the first end joined with at least one of the upper portion and the sole portion, the cord extending toward the strap, the cord being selectively slidably housed in the sleeve, the cord joining and extending between the strap and the at least one of the upper portion and the sole portion; and an adjustment element selectively locatable along a part of the cord to establish a preselected length of the cord between the part of the cord and the first end of the cord so that the strap is positioned in a preselected spatial relationship relative to the at least one of the upper portion and the sole portion, wherein the strap engages at least one of the wearer's foot and the wearer's ankle to at least partially retain the footwear on the wearer's foot.

13. The footwear construction of claim 12 wherein the strap is an ankle strap and is spaced from the upper portion, wherein the cord is adapted to wrap at least partially around the ankle of the wearer, wherein the upper portion extends at least partially over a forefoot region of the footwear.

14. The footwear construction of claim 12 wherein the upper portion is in the form of a sandal and includes at least one other strap.

15. The footwear construction of claim 14 wherein the adjustment element is a knot tied in the cord.

16. The footwear construction of claim 12 wherein the cord is joined with the sole portion so that the cord is adapted to extend upwardly from the sole and between adjacent toes of a wearer of the footwear.

17. A method of making a footwear construction comprising:

joining a sole including a sole portion with an upper including an upper portion;

providing a strap defining a sleeve, the strap spaced from at least one of the upper portion and the sole portion;

joining a first end of a cord with at least one of the upper portion and the sole portion;

extending the cord toward the strap;

positioning the cord in the sleeve so that the cord is selectively slidable in the sleeve, the cord joining the strap and the at least one of the upper portion and the sole portion;

sliding the cord in the sleeve, with a part of the cord extending beyond the sleeve; and positioning an adjustment element along the part of the cord extending beyond the sleeve to establish a preselected length of the cord between the part of the cord and a first end of the cord joined with the at least one of the upper portion and the sole portion so that the strap is positioned in a preselected spatial relationship relative to the at least one of the upper portion and the sole portion, wherein the strap is adapted to engage at least one of the wearer's foot and ankle to at least partially retain the footwear on a wearer's foot.

18. The method of claim 17 comprising tying a knot in the cord to produce the adjustment element.

19. The method of claim 17 comprising joining the first end of the cord with the sole portion in a location in a forefoot region of the footwear so that the cord is adapted to extend between at least two adjacent toes of the wearer, and so that the strap is adapted to be positioned above the top of a forefoot of the wearer's foot when the footwear is on the wearer's foot.

20. The method of claim 17 comprising pulling, with the cord, the strap closer to the at least one of the upper portion and the sole portion.

* * * * *